United States Patent [19]

Takakura et al.

[11] Patent Number: 4,886,995

[45] Date of Patent: Dec. 12, 1989

[54] HEATER FOR INDIRECTLY-HEATED CATHODE

[75] Inventors: Hiroshi Takakura; Sachio Koizumi, both of Mobara, Japan

[73] Assignee: Hitachi, Ltd., Tokyo, Japan

[21] Appl. No.: 897,216

[22] Filed: Aug. 18, 1986

[30] Foreign Application Priority Data

Sep. 4, 1985 [JP] Japan ..... 60-193709

[51] Int. Cl.[4] ..... H01J 1/16

[52] U.S. Cl. ..... 313/344; 313/341; 219/236; 72/135

[58] Field of Search ..... 445/48; 313/344, 346 DC, 313/341; 315/94; 219/236; 72/135, 146, 148

[56] References Cited

U.S. PATENT DOCUMENTS 3,255,375 6/1966 Ward ..... 313/344
3,294,125 12/1966 Heine ..... 72/135
4,441,048 4/1984 Takaoka et al. ..... 313/346 DC

FOREIGN PATENT DOCUMENTS 52-130273 11/1977 Japan .
61-50564 3/1986 Japan .

*Primary Examiner*—Robert L. Griffin
*Assistant Examiner*—T. Salindong
*Attorney, Agent, or Firm*—Antonelli, Terry & Wands

[57] ABSTRACT

The improved structure of a heater for an indirectly-heated cathode which is used for CRTs or the like is disclosed. A core wire for a heater is wound around a mandrel into a primary winding so that the inner diameter of the primary winding is 4.3 to 6.0 times the diameter of the core wire. The primary winding may be further wound into a secondary winding.

6 Claims, 2 Drawing Sheets

HEATER FOR INDIRECTLY-HEATED CATHODE

BACKGROUND OF THE INVENTION

The present invention relates to a heater for an indirectly-heated cathode and, more particularly, to the structure of a coil winding of a cathode heater.

This kind of cathode heater is used as, for example, a thermionic emission heater which constitutes an electron gun of a color picture tube, and has what is called a duplex winding structure in which a core wire having tungsten as the main constituent is wound around a molybdenum mandrel into a coil as a primary winding and the coil is further coiled into a secondary winding. Such a structure of a heater for indirectly-heated cathode is well known, and is described in, for example, Japanese Patent Provisional Publication No. 50564/'76.

However, in the primary winding of a cathode heater in which a molybdenum mandrel is utilized, the diameter of the molybdenum mandrel is ordinarily 1.9 to 4.0 times that of the tungsten core wire, the diameter of the mandrel being ordinarily the same as the inner diameter of the primary winding. As a result, when the tungsten core wire is wound around the molybdenum mandrel so as to constitute the first winding, compression stress is applied to the inward of the winding direction of the tungsten core wire and tensile stress is applied to the outward of the winding direction thereof. The smaller the ratio of the diameter of the molybdenum mandrel to that of the tungsten core wire, the larger become these stresses. If these stresses are large, the mechanical strength of a heater constituted by the winding is disadvantageously so reduced as to generate breaking of wire.

SUMMARY OF THE INVENTION

Accordingly, it is an object of the present invention to ameliorate the above-described problems in the prior art and to provide a heater for an indirectly-heated cathode which is improved in mechanical strength by mitigating the strain due to compressive stress and tensile stress (hereinunder referred to as "winding strain") which are applied to the tungsten core wire constituting a cathode heater during the production thereof, thereby enhancing the reliability of the cathode heater with respect to prevention of breaking of wire.

To achieve this aim, according to the present invention, a primary winding is formed with the ratio D/d of the diameter D of a molybdenum mandrel to the diameter d of a tungsten core wire being set at 4.3 to 6.0.

The above and other objects, features and advantages of the present invention will become clear from the following description of the preferred embodiment thereof, taken in conjunction with the accompanying drawings.

DESCRIPTION OF THE PREFERRED EMBODIMENT

Figure 1:
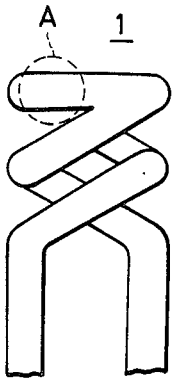
FIGS. 1, 2 and 3 are plan views of the main part of an embodiment of a heater for an indirectly-heated cathode according to the present invention.
Figure 2:
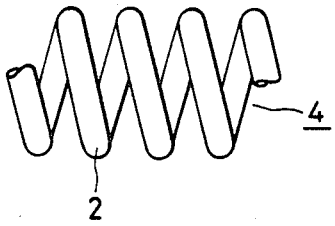
Figure 3:
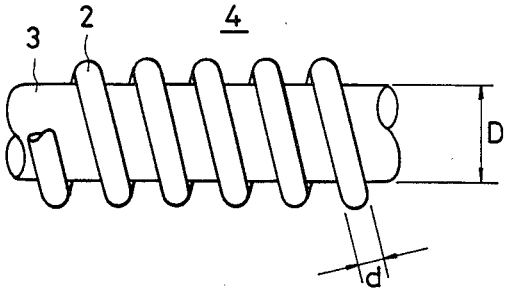

FIGS. 1, 2 and 3 are plan views of the main part of an embodiment of a heater for an indirectly-heated cathode according to the present invention.

The reference numeral 1 in FIG. 1 denotes a cathode and FIG. 2 is an enlarged view of the structure of the portion A in FIG. 1. A tungsten core wire 2 having a diameter of about several ten μm is wound around the outer peripheral surface of a molybdenum mandrel 3 shown in FIG. 3 to form a primary coil winding 4. The primary coil winding 4 together with the mandrel 3 is further wound around a second mandrel (not shown) having a larger diameter than that of the mandrel 3 to form a secondary winding. Thereafter the secondary winding is subjected to a treatment such as aluminum electrodeposition and then the mandrel 3 is dissolved by mixed acid consisting of, for example, nitric acid, sulfuric acid and water, whereby the double-coil type heater 1 is obtained.

In a conventional cathode heater, the ratio D/d of the outer diameter D of the molybdenum mandrel 3 to the diameter d of the tungsten core wire 2 is about 4, and the winding strain due to compressive stress and tensile stress are applied to the tungsten core wire 2 itself during the production of the primary winding 4, so that when it is incorporated into the cathode heater 1, the mechanical strength is reduced.

Figure 4:
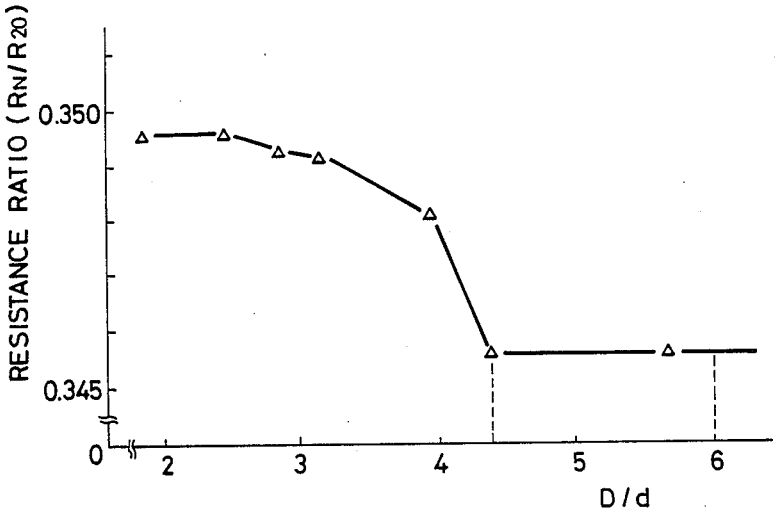
FIG. 4 is a graph showing the relationship between the ratio D/d of the diameter D of a molybdenum mandrel to the diameter d of a tungsten core wire and the resistance ratio $RN/R_{20}$ of the cathode heater.
Figure 5:
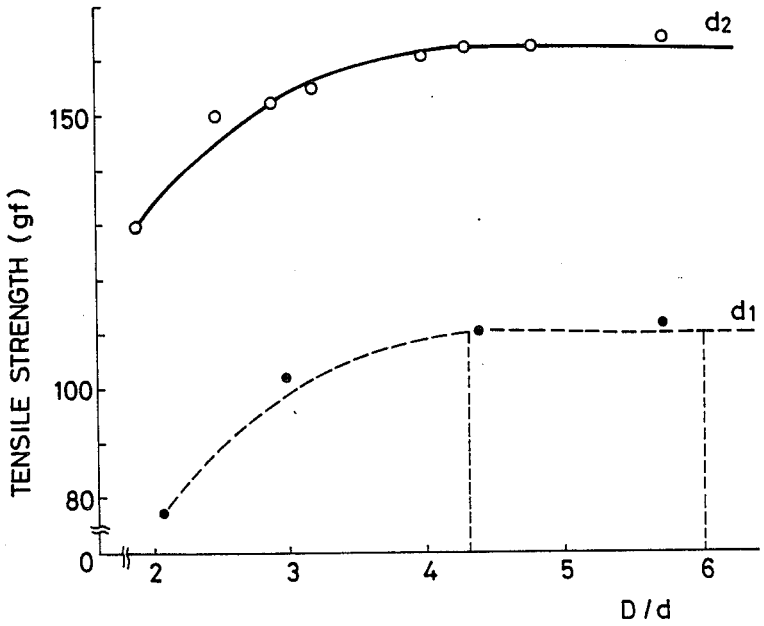
FIG. 5 shows the relationship between the ratio D/d and the tensile strength of the cathode heater.

To eliminate this problem, according to the present invention, the ratio D/d of the outer diameter D of the molybdenum mandrel 3 to the diameter d of the tungsten core wire 2 is set at about 4.3 to 6.0, and after the formation of the primary winding 4 shown in FIG. 2 a secondary winding is formed to obtain the heater 1 shown in FIG. 1. If the ratio D/d is less than 4.3, the resistance ratio of the primary winding 4 increases, as shown in FIG. 4. In both cases in which the diameter of the tungsten core wire 2 are $d_1=25.7$ μm and $d_2=31.7$ μm, the tensile strength of the cathode heater is degraded so much as to be insufficient for practical use. In FIG. 4, RN represents the resistance value of the tungsten core wire which is put into liquid nitrogen at −196 ° C., and $R_{20}$ the resistance value of the core wire at an ordinary temperature of 20° C. The resistance ratio $RN/R_{20}$ is a value showing the degree of the residual strain of the core wire. On the other hand, if the ratio D/d becomes so large as to exceed 6 (not shown), the plastic deformation of the tungsten core wire during winding becomes inadequate due to the tension of the winding. Consequently, since it is difficult to maintain the pitch accuracy of the winding at a predetermined value, there are too wide variations in winding for practical use. Accordingly, it is preferable to produce a utilizable cathode heater so that the ratio D/d is in the range of 4.3 to 6.0.

Thus, the primary winding 4 having the above-described structure is formed with the ratio of outer diameter of the molybdenum mandrel 3 to the diameter of the tungsten core wire 2 being set at 4.3 to 6.0, thereby greatly reducing the winding strain due to compressive stress applied to the inward of the winding direction and tensile stress applied to the outward of the winding direction of the tungsten core wire 2 while the tungsten core wire 2 is wound around the molybdenum mandrel 3. As a result, the mechanical strength of the primary winding 4 is enhanced, so that the breaking of wire in the heater 1 is prevented.

Although a double coil type cathode heater is illustrated in this embodiment, it goes without saying that the present invention is adaptable to a single coil type cathode heater.

As described above, the cathode heater in accordance with the present invention is very advantageous in that the winding strain during the production of the heater is mitigated, the mechanical strength is improved, and the reliability with respect to prevention of breaking of wire is enhanced.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. A heater for an indirectly-heated cathode comprising a coiled heater composed of a core wire for a cathode heater wound around a mandrel to form a winding, characterized in that the largest inner diameter of said winding is 4.3 to 6.0 times the diameter of said core wire.

2. A heater according to claim 1, wherein said winding is substantially circular and the largest inner diameter of said winding is 4.3 to 6.0 times the diameter of said core wire over the entirety of said winding.

3. A heater according to claim 1, wherein said winding is wound around a single mandrel and the largest inner diameter of said winding is determined by at least the diameter of said single mandrel.

4. A heater for an indirectly-heated cathode comprising a double-coil heater obtained by winding a core wire for a cathode heater around a mandrel to form a primary winding and further winding said primary winding into a secondary winding, characterized in that the largest inner diameter of said primary winding is 4.3 to 6.0 times the diameter of said core wire.

5. A heater according to claim 4, wherein said primary winding is substantially circular and the largest inner diameter of said primary winding is 4.3 to 6.0 times the diameter of said core wire over the entirety of said winding.

6. A heater according to claim 4, wherein said primary winding is wound around a single mandrel and the largest inner diameter of said primary winding is determined by at least the diameter of said single mandrel.

* * * * *